US010398929B2

(12) United States Patent
Hsieh

(10) Patent No.: US 10,398,929 B2
(45) Date of Patent: Sep. 3, 2019

(54) BENCH WITH ADJUSTABLE SEAT

(71) Applicant: Jackson Hsieh, City of Industry, CA (US)

(72) Inventor: Jackson Hsieh, City of Industry, CA (US)

(73) Assignee: Paradigm Health and Wellness, City of Industry, CA (US)

( * ) Notice: Subject to any disclaimer, the term of this patent is extended or adjusted under 35 U.S.C. 154(b) by 0 days.

(21) Appl. No.: 15/890,235

(22) Filed: Feb. 6, 2018

(65) Prior Publication Data

US 2019/0240527 A1 Aug. 8, 2019

(51) Int. Cl.
*B60N 2/00* (2006.01)
*A63B 21/00* (2006.01)

(52) U.S. Cl.
CPC ..... *A63B 21/4029* (2015.10); *A63B 21/4047* (2015.10); *A63B 21/00047* (2013.01); *A63B 2225/093* (2013.01)

(58) Field of Classification Search
CPC ..... A63B 21/4029; A63B 21/4047; A63B 21/00047; A63B 2225/093
USPC ..... 297/354.13
See application file for complete search history.

(56) References Cited

U.S. PATENT DOCUMENTS 4,566,691 A 1/1986 Mahnke
4,635,934 A * 1/1987 Roethke ..... A63B 21/154 482/104
4,653,751 A * 3/1987 Green ..... A63B 21/4029 482/104
4,936,572 A 6/1990 Desiderio
5,776,037 A 7/1998 Millington
6,371,896 B1 4/2002 Kettler
6,605,023 B1 8/2003 Mobley
6,645,130 B2 11/2003 Webber
6,659,923 B2 12/2003 Teuscher
6,884,203 B2 4/2005 Forcillo
7,294,097 B2 11/2007 Parker
7,331,912 B2 2/2008 Keiser et al.
7,331,913 B2 2/2008 Forcillo
7,384,383 B2 6/2008 Forcillo et al.
7,674,215 B1 3/2010 Swanson et al.
8,012,072 B2 9/2011 Forcillo et al.
2005/0197238 A1 9/2005 Parker
2010/0125030 A1* 5/2010 Shifferaw ..... A63B 21/00181 482/94
2016/0302988 A1* 10/2016 Heimann ..... A63B 21/0023
2017/0001064 A1* 1/2017 Vorozilchak ..... A63B 21/4047

* cited by examiner

*Primary Examiner* — Mark R Wendell

(74) *Attorney, Agent, or Firm* — Kirk A. Buhler; Buhler & Associates Patenting

(57) ABSTRACT

Improvements in an adjusting bench includes a back frame which includes a back support and a back adjusting arrangement to adjust inclination situation of the back support, a seat frame including a seat support and a seat adjusting arrangement to adjust a height of the seat support and a distance between the seat support and the back support, a supporting frame including a first leg frame and a second leg frame adapted to support the back support and the seat support securely standing on a ground floor.

18 Claims, 7 Drawing Sheets

BENCH WITH ADJUSTABLE SEAT

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements to a bench, and more particularly to an adjustable bench which has an adjustable back support and an adjustable seat support to be selectively adjusted for providing comfort and complete lower back support at a variety of angles Description of Related Art Including Information Disclosed Under 37 CFR 1.97 and 1.98:

A workout bench is a common exercise equipment for the users who work out in their homes or in club gyms. The workout bench is designed for the users to efficiently perform sit-ups, abdominal work, and upper body workout. A conventional type of bench comprises a body bench, a pair of foam-cushioned leg pad, and a supporting frame to support the body bench standing on the ground floor to from a predetermined angle of inclination with respect to the ground floor. This type of bench is often designed to be compact for easier storage, so the length and size thereof is regular, and the angle between the bench body and the ground floor cannot be changed. Since the structure of this type of bench is fixed, this type of bench does not have a gap issue, so the number of the exercises available for users is severely limited by the fixed angle structure of the conventional bench. Therefore, the users need to purchase multiple pieces of equipment in order to have a wide variety of work-out angles to achieve the best exercising results.

In addition, an improved adjustable workout bench is provided in the current market, wherein the improved adjustable workout bench comprises a seat support, a back support, a pair of foam-cushioned leg pad, a supporting frame to support the seat support and the back support standing on the ground floor to from a predetermined angle of inclination with respect to the ground floor, and a back adjusting arrangement adapted to adjust the angle between the back support and the supporting frame. In other words, the angle between the back support and the supporting frame is adjustable in order to meet the user needs for a variety of exercises. However, this improved adjustable workout bench has a major drawback. The mechanism structure of the back-adjusting arrangement allows for a gap between the seat and the backrest. While the user is sitting or lying on the improved adjustable workout bench, the user's lower back is not supported due to the gap that is created between the backrest and the seat. Additionally, the structure of many benches creates a miss-match opening between the surfaces and creates a protrusion that passes through the gap that will dig into the user's back.

What is needed is a bench with an adjustable seat and adjustable backrest that includes many angles and provides full lower back support by eliminating the gap between the backrest and the seat. The elimination of the gap between the seat and backrest also prevents pain due to the user coming in contact with the bench frame. The disclosure found in this document provides the solution.

BRIEF SUMMARY OF THE INVENTION

It is an object of the adjustable bench to provide an adjustable bench which comprises an inclinable back support and a seat support which is able to move towards the back support, and the height of the seat support is adjustable.

It is another object of the adjustable bench to provide an adjustable bench, wherein the adjustable bench comprises a supporting frame having a first leg member and a second leg member adapted to support the back support and the seat support to securely standing on the ground floor.

It is another object of the adjustable bench to provide an adjustable bench, wherein the adjustable bench comprises a back adjusting arrangement having a plurality of angle adjusting retainers arranged on the first leg member and an adjusting arm inclinedly arranged between the back support and the first leg member to securely lock on one of the angle adjusting retainers.

It is another object of the adjustable bench to provide an adjustable backrest, wherein the adjusting leg comprises a pivot end pivotally connected on a predetermined position of a bottom face of the back support and a free end movably locked on the angle adjusting retainer to from an adjusting angle between the back support and the first leg member.

It is another object of the adjustable bench to provide an adjustable seat, wherein the supporting frame comprises a seat adjusting arrangement having a common pivot end pivotally connected on the bottom front end of the back support adapted to activate transversal movement of the seat support.

It is another object of the adjustable bench to provide an adjustable bench, wherein the seat adjusting arrangement comprises a first seat adjustor adapted with locking hole in the first seat adjustor to provide adjust of a distance between the seat support and the bench or back support.

It is another object of the adjustable bench to provide an adjustable bench, wherein the adjustable bench comprises a second seat adjustor having a plurality of second locking holes formed thereon and a second seat locker selectively inserted into one of the second locking holes to adjust the height of the seat support.

It is still another object of the adjustable bench to provide an adjustable bench, wherein no expensive and complicated structure is required to be employed in the present invention in order to achieve the above-mentioned objects. Therefore, the present invention successfully provides an economic and efficient solution that allows the user easily adjust locations of the back support and the seat support to fit with different kinds of bodies of the users.

According to the adjustable bench, the foregoing and other objects and advantages are attained by an adjusting bench, comprising: a back frame comprising a back support and a back adjusting arrangement to adjust an inclination situation of the back support. A seat frame comprising a seat support and a seat adjusting arrangement to adjust a height of the seat support and a distance between the seat support and the back support. A supporting frame comprising a first leg frame and a second leg frame adapted to support the back support and the seat support securely standing on a ground floor.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
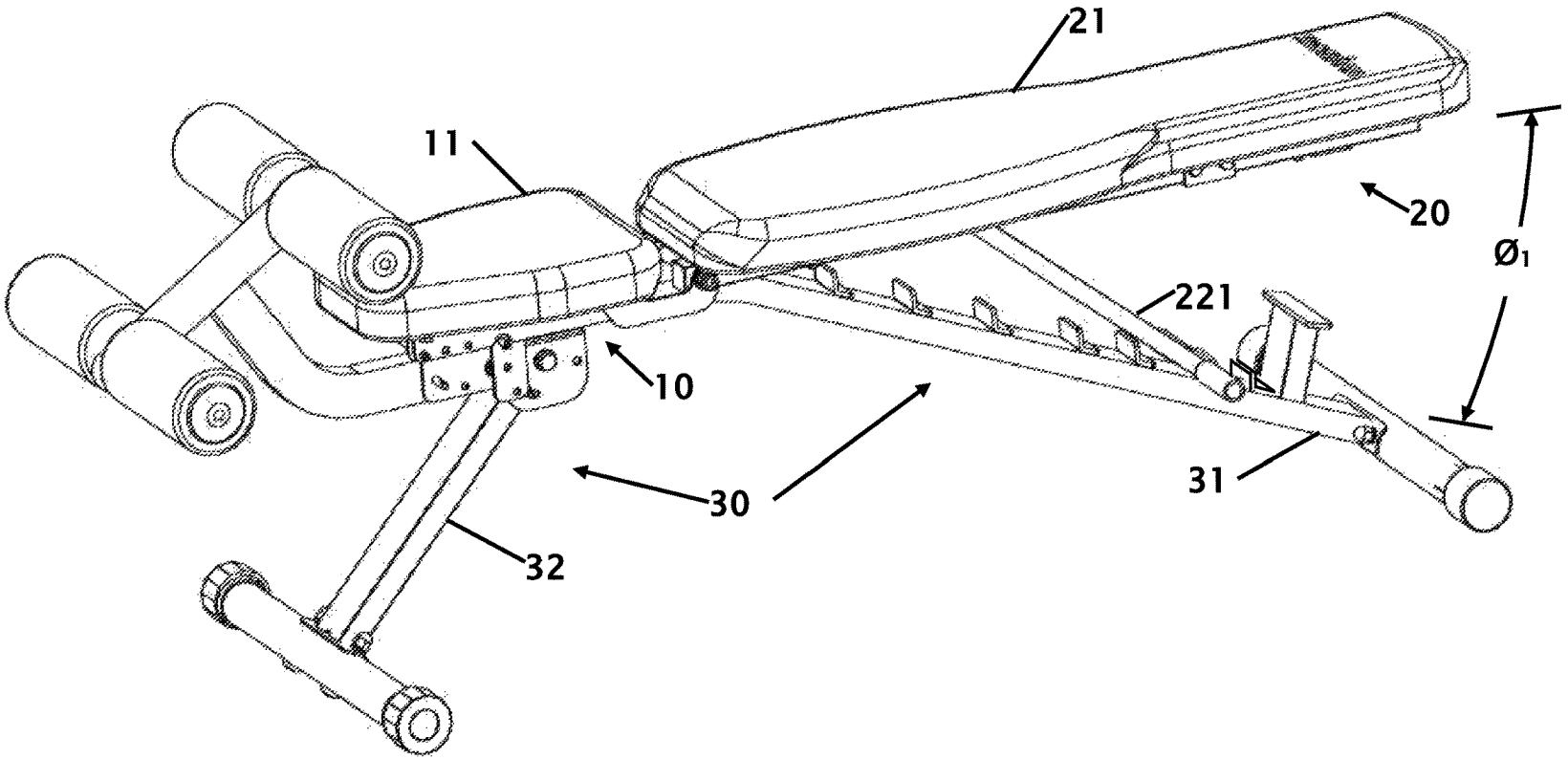
FIG. 1 is a perspective view of an adjustable bench according to a preferred embodiment of the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Figure 2:
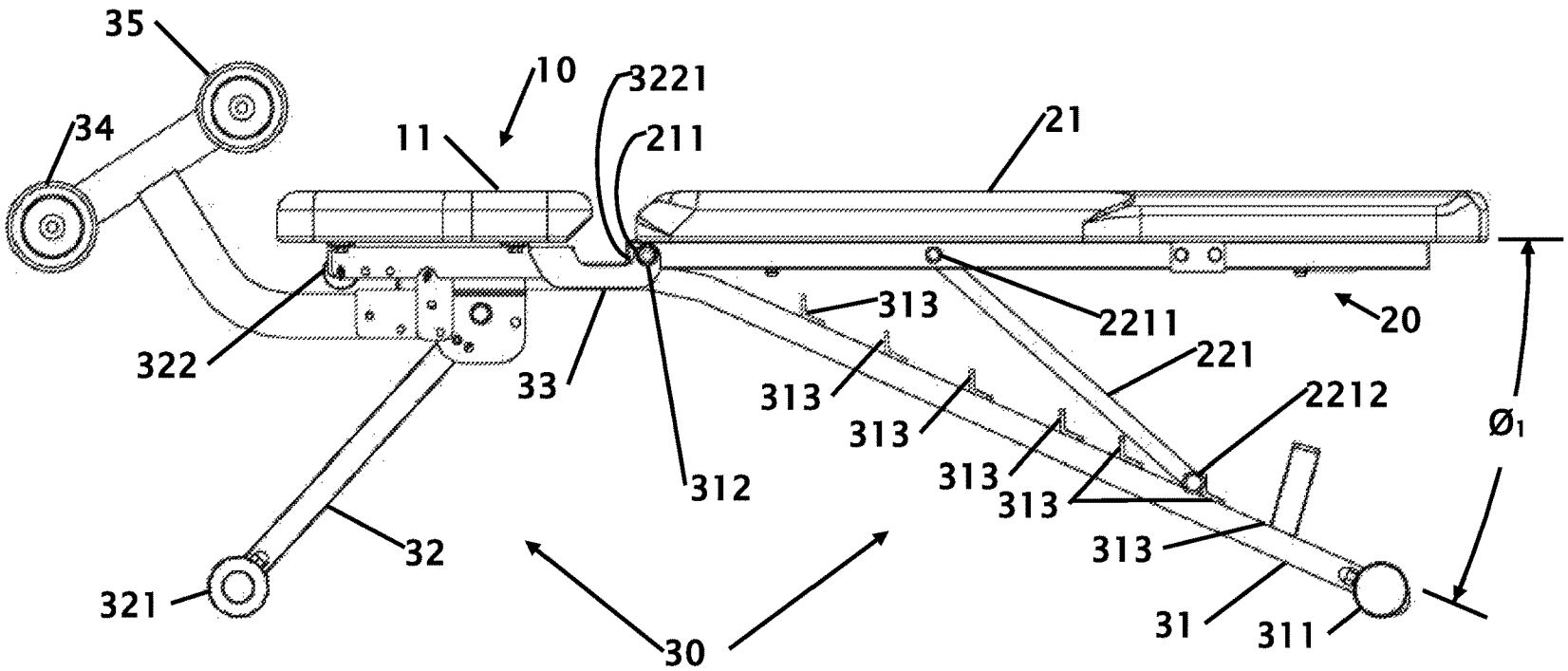
FIG. 2 is a side view of an adjustable bench according to the above preferred embodiment of the present invention.
Figure 3:
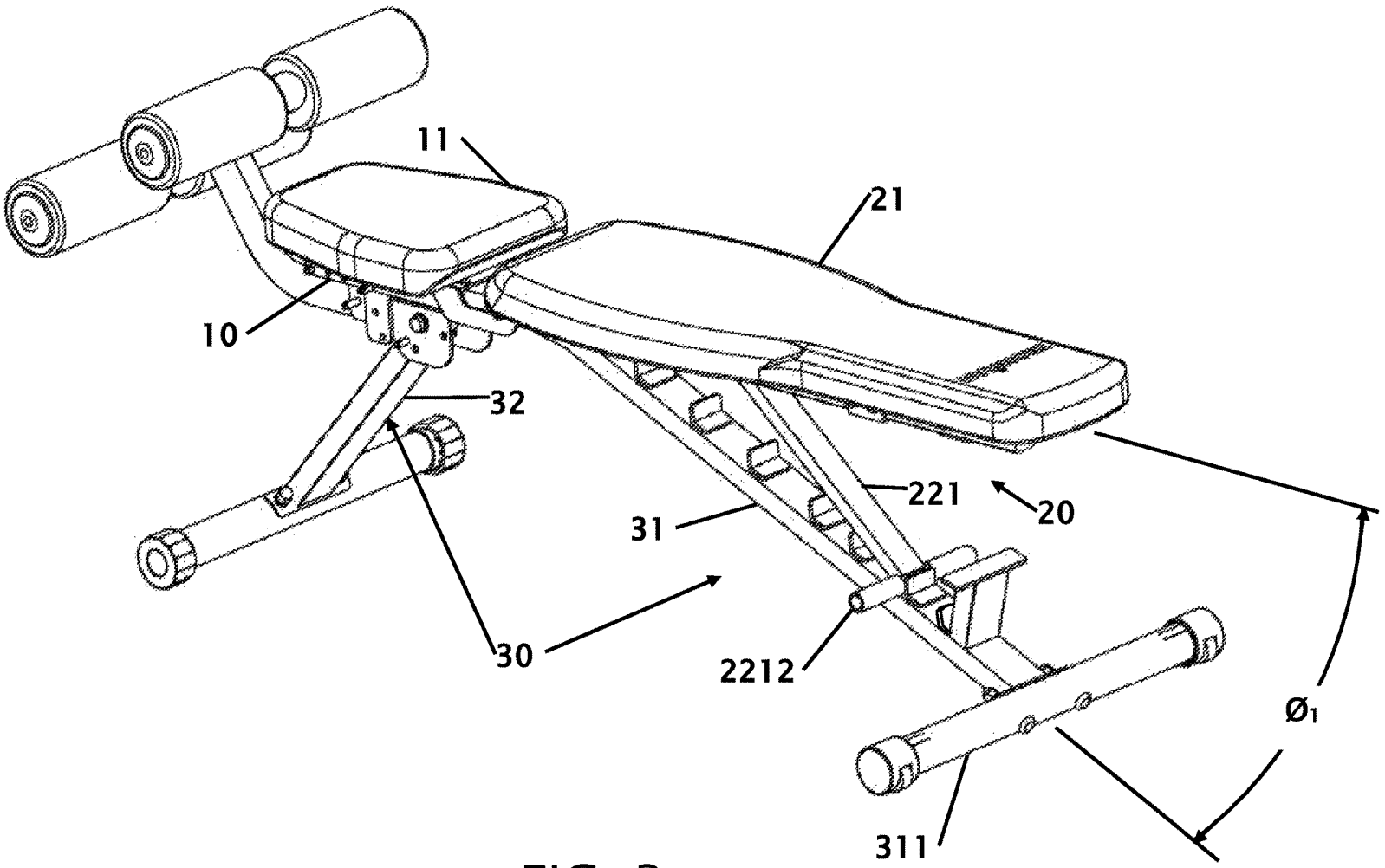
FIG. 3 is a perspective view of an adjustable bench according to a preferred embodiment of the present invention.

ITEM NUMBERS AND DESCRIPTION $Ø_1$ adjusting angle
$Ø_2$ elevated angle
10 seat frame
11 seat support
12 seat adjusting arrangement
20 back frame
21 bench
30 supporting frame
31 first leg member
32 second leg member
33 seat supporting frame
34 padded leg pad
35 foam roller
36 ankle pad leg frame member
40 pin
41 hole
50 plate
51 hole
52 hole
53 pin
60 second seat adjustor/locker
61 second locking holes
63 third locking holes
111 seat cushion
122 first seat adjustor
122A locking holes
122B locking holes
211 bottom front end
221 adjustable leg
311 first free end
312 first pivot end
313 angle adjusting retainers
322 seat supporting frame
2211 pivot end
2212 free end
3221 second fixed end Referring to FIG. 1 to FIG. 3 of the drawings, an adjustable bench according to a preferred embodiment of the present invention is illustrated, wherein the adjustable bench comprises a seat frame 10, a back frame 20 with a cushioned bench 21, and a supporting frame 30 adapted to support the adjustable bench being standing on the ground floor.

Accordingly, the back frame 20 comprises a back-frame part with a cushioned bench 21 and a back adjustable leg 221. The seat frame 10 comprises a seat support 11, so that the back frame 20 and the seat support 11 are end-to-end, longitudinally arranged on the adjustable bench. The back frame 20 and the seat support 11 are pivotally connected with each other and are supported by the supporting frame 30 to standing on a ground floor.

It is worth mentioning that the supporting frame 30 comprises a first leg member 31, a second leg member 32, and an adjusting leg 221, wherein first leg member 31 comprises a first free end 311 biased against the ground floor and a first pivot end 312 pivotally connected to a bottom front end 211 of the back frame 20, wherein the first leg member 31 is arranged on an incline with respect to the ground floor.

The back adjusting arrangement, shown in FIG. 2, comprises a adjusting leg 221 in an inclined arranged between the back frame 20 and the first leg member 31, and a plurality of angle adjusting retainers 313 which are spaced apart to incorporate with the adjusting leg 221 to support the back frame part 20 being securely standing on the ground floor, wherein the adjusting leg 221 comprises a pivot end 2211 pivotally connected on a predetermined position of a bottom face of the back frame 20 and a free end 2212 movably locked on one of the angle adjusting retainers 313 to form an adjusting angle θ between back frame 20 and the first leg member 31. In other words, the free end 2212 of the adjusting leg 221 can be selectively locked on one of the angle adjusting retainers 313 so as to form different degrees of adjusting angles.

Accordingly, the adjusting angle θ is gradually increased when the adjusting leg 221 is locked from the angle adjusting retainer 313 adjacent to the first free end 311 of the first leg member 31 to the angle adjusting retainer 313 farthest to the first free end 311 of the first leg member 31. While the free end 2212 of the adjusting leg 221 is locked on the angle adjusting retainer 313 which is located adjacent to the first free end 311 of the first leg member 31, the adjusting angle $\theta_1$ is formed between the back frame 20 and the first leg member 31. While the free end 2212 of the adjusting leg 221 is locked on the angle adjusting retainer 313 which is located farthest to the first free end 311 of the first leg member 31, the elevated angle $\theta_2$ (shown in other figures) is formed between the back frame 20 and the first leg member 31. Accordingly, the amount of the adjusting angle $\theta_1$ is smaller than that of the elevated angle. The angle of the bench can be less than horizontal and can form a decline.

As shown in FIG. 2, the supporting frame 30 further comprises a second leg member 32 having a second free end 321 biased against the ground floor and a seat supporting frame 322 supported under the seat support 11, wherein the seat supporting frame 322 comprises a second fixed end 3221 fixedly connected with the first pivot end 312 of the first leg member 31 so as to connect the second leg member 32 with the first leg member 31. It is worth mentioning that while the user is sitting or lying on the adjustable bench, a certain amount of applied force is applied on the seat support 11, so the seat supporting frame 33 is adapted to guide the applied force from the seat supporting frame 33 to be evenly distributed to the first leg member 31 and the second leg member 32. In other words, the applied force also is applied on the back frame 20, and the applied force is guided to the second leg member 32 through the seat supporting frame 33, and also guided to the first leg member 31 through the adjusting leg 221.

While the adjustable bench is in use, the applied force can be evenly distributed to the first leg member 31 and the second leg member 32, so no longitudinal or transversal movement will be generated within the entire structure of the adjustable bench, and the structure of the adjustable bench is secure and stable. Accordingly, since the adjusting leg 221 is biased against one of the angle adjusting retainers 313, the applied force is guided along the adjusting leg 221. The free end 2212 of the adjusting leg 221 is securely locked on one of the angle adjusting retainers 313 due to the applied force, so the applied force can be transmitted to the first leg member 31.

The adjustable bench further comprises a pair of cushioned or padded leg pads 34 and 35 arranged along the seat support 11, wherein the foam-cushioned padded leg pads 34 and foam roller 35 are adapted to provide the user for placing their legs thereon while the user is sitting or lying on the seat support 11 and the back frame 20. In addition, the user is able to lock their legs on the foam-cushioned padded leg pad 34 and foam roller 35. This allows the user to anchor their legs in the padded rollers 34 and 35 to support the user as they exercise abdominal muscle or core muscles. Foam roller 35 can provide functions like "sit up leg holder, single leg squat . . . ".

It is worth mentioning that seat supporting frame 33 is a U-shaped or L-shaped structure having a common first pivot end 312. The common first pivot end 312 is pivotally connected with the bottom front end 211 at the first leg member 31 and the second fixed end 3221 of the adjustable seat frame 10, so that the common first pivot end 312 is formed as a connection point to not only connect the back frame 20 and the seat support 11, but also connect the first leg member 31 and the second leg member 32.

Figure 4:
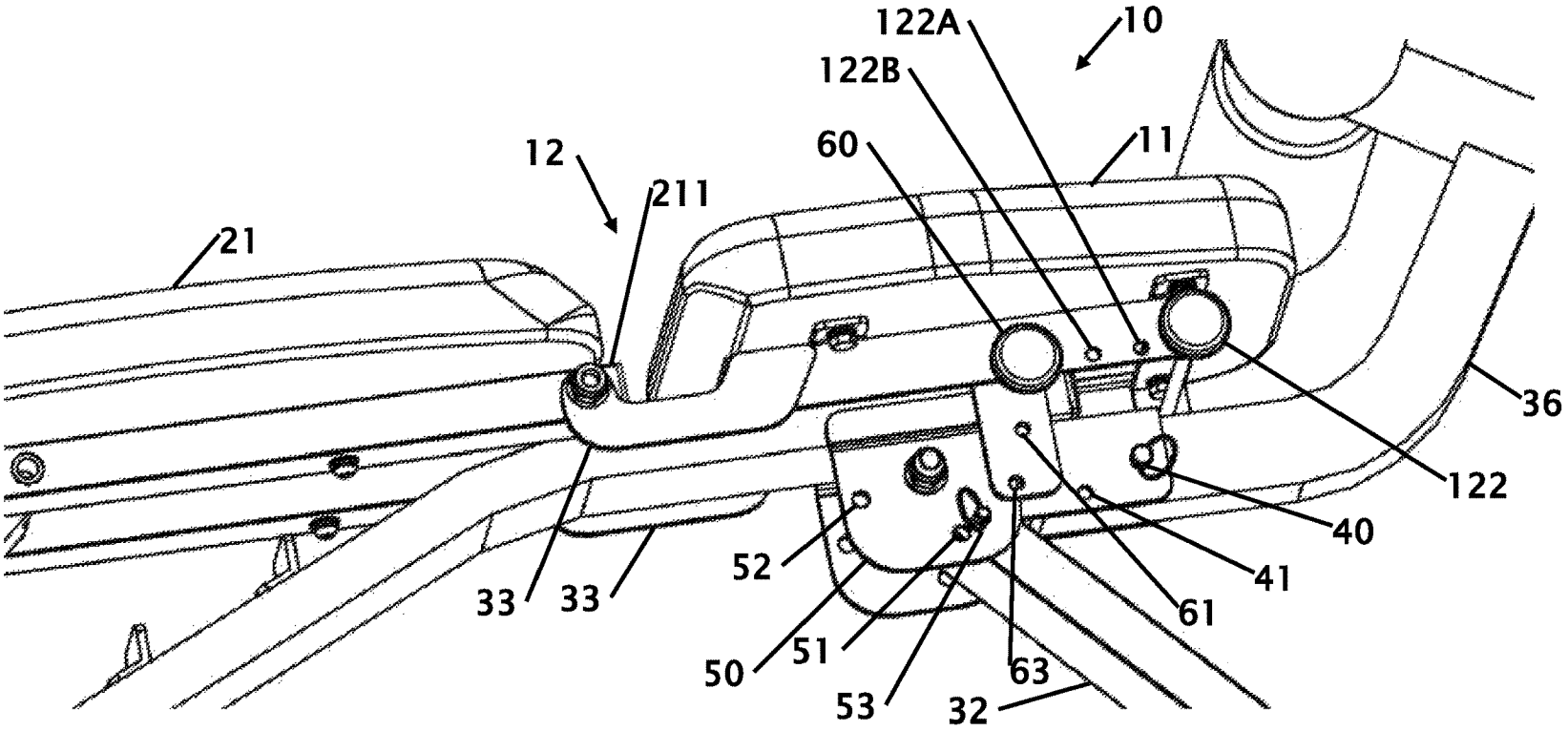
FIG. 4 is a sectional view of a seat adjusting arrangement of an adjustable bench according to the above preferred embodiment of the present invention.
Figure 5:
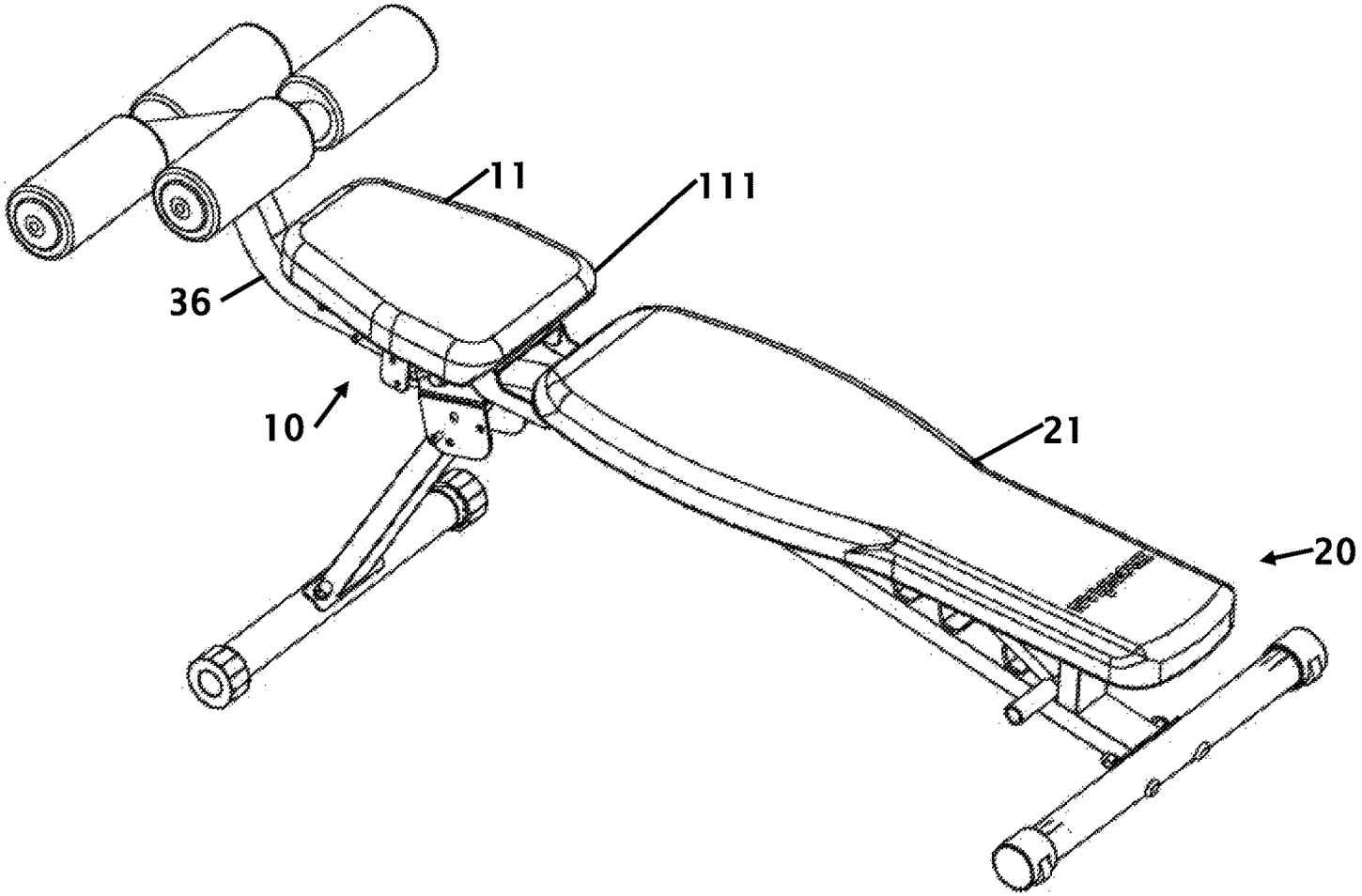
FIG. 5 is a perspective view of an adjustable bench according to the above preferred embodiment of the present invention, illustrating a first seat locker position.
Figure 6:
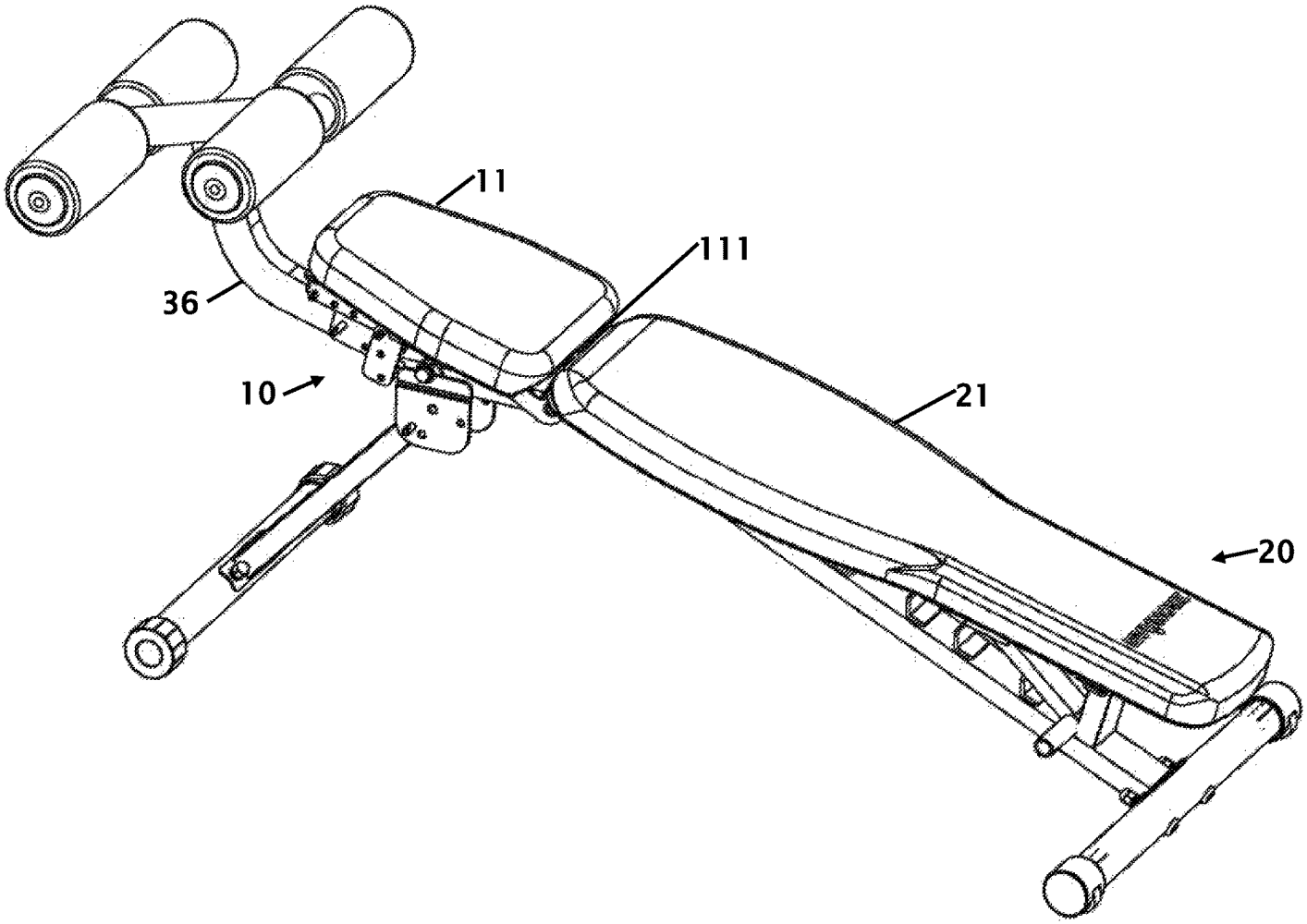
FIG. 6 is a perspective view of an adjustable bench according to the above preferred embodiment of the present invention, illustrating a second seat locker position.

Referring to FIG. 4 to FIG. 6 of the drawings, the seat frame 10 further comprises a seat adjusting arrangement 12 comprising a first seat adjustor 122 located, wherein the first seat adjustor 122 is operatively linked with the seat support 11, so that the seat support 11 is interlocked with the first seat adjustor 122. The first seat adjustor 122 comprises a plurality of locking holes 122A and 1228, wherein the locking holes 122A and 122B are spaced apart from each other. A seat cushion 111 is located on top of the seat support 11.

Figure 7:
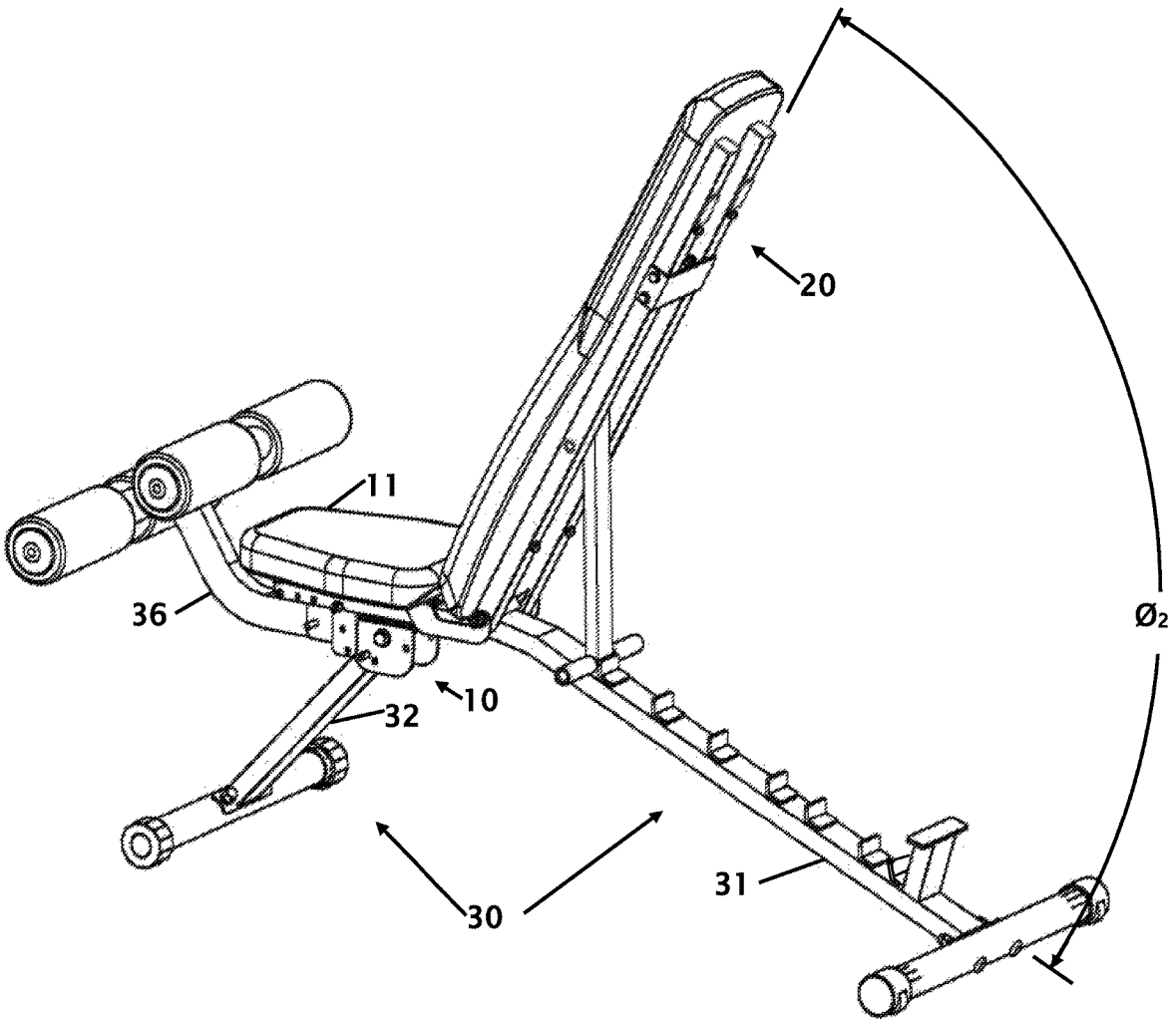
FIG. 7 is a perspective view of an adjustable bench according to the above preferred embodiment of the present invention, illustrating that a second seat locking pin is inserted into the second locking position.

Referring to FIG. 4 and FIG. 7, the seat adjusting arrangement 12 further comprises a second seat adjustor/locker 60 operatively linked with the seat support 11 and a second seat adjustor/locker 60 is a rectangular plate shaped structure which is longitudinally arranged with respect to the seat support 11. In addition, a plurality of second locking holes 61 are spaced apart on the second seat adjustor/locker 60, wherein the second seat adjuster/locker 60 can be selectively inserted into one of the second locking holes 61 so as to lift up the seat support 11. In other words, a lifting force is applied by the second seat adjustor/locker 60 to lift up the seat support 11.

As shown in FIG. 4 and FIG. 7, the second seat locker 60 can be inserted into the second locking hole 61, or third locking hole 63, while lifting on the seat support 11 a distance. Therefore, the seat support 11 can be gradually lifted up to the desired elevation and the pin 40 can be inserted to set the desired elevation of seat support 11.

In FIG. 4, the angle of the ankle pad leg frame member 36 that supports the padded leg pad 34 and foam roller 35 is further adjustable relative to the second leg member 32, by removing pin 40 and positioning the pin 40 into hole 41. This will alter he angle of the ankle pad leg frame member 36 relative to the seat support 11. Adjustment of the second leg member 32 is adjustable by removing pin 53 and repositioning the second leg member 32 to allow alignment with holes 51 and 52 on plate 50. The angle θ2 is formed between the back frame 20 and the first leg member 31 and can vary from a decline to 90 degrees.

Thus, specific embodiments of an adjustable bench have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An adjusting bench comprising:

a back frame comprising a back support and a back adjusting arrangement to adjust inclination situation of said back support;

said back support has an adjustable leg that is pivotally secured to said back support;

a seat frame comprising a seat support and a seat adjusting arrangement to independently adjust an angle of said seat support relative to said back support and a distance between said seat support and said back support;

a supporting frame comprising a first leg member and a second leg member adapted to support said back support and said seat support securely standing on a ground floor;

said first leg member includes a plurality of angle adjusting retainers, and said distance between said seat support and said back support is independently adjustable from back support.

2. The adjusting bench according to claim 1, wherein a distance between said back support and said seat frame is adjustable.

3. The adjusting bench according to claim 2, wherein said distance between said back support and said seat frame is adjustable with a seat adjuster that is operatively linked with a seat support.

4. The adjusting bench according to claim 3, wherein said seat adjuster consists of a plurality of holes spaced apart and a pin that is inserted through a set of said plurality of holes and said seat.

5. The adjusting bench according to claim 3, wherein said second leg member is adjustable by removing a pin from a first plurality of holes in said second leg and in a plate, repositioning said second leg member, aligning a second plurality of holes in said plate with said first plurality of holes in said second leg member and inserting said pin.

6. The adjusting bench according to claim 1, wherein an angle between said back support and said seat frame is adjustable.

7. The adjusting bench according to claim 6, wherein said angle between said back support and said seat frame is adjustable with a seat adjuster that is operatively linked with a seat support.

8. The adjusting bench according to claim 7, wherein said angle between said back support and said seat is adjustable by removing a pin from a plate, repositioning said seat frame, aligning a plurality of holes in said plate with a plurality of holes in said seat frame and inserting said pin.

9. The adjusting bench according to claim 1, wherein an angle between said seat frame and said second leg member is independently adjustable from adjustment of said second leg member.

10. The adjusting bench according to claim 1, wherein an angle between said seat frame and a cushioned or padded ankle pad leg frame member is adjustable.

11. The adjusting bench according to claim 10, wherein an angle between said seat frame and said cushioned or padded ankle pad leg frame member is adjustable by removing a pin from a plate, repositioning by rotating said second leg member on said plate, aligning a plurality of holes in said plate with a plurality of holes in said second leg member and inserting said pin.

12. The adjusting bench according to claim 1, wherein said adjustable leg is positioned in one of said plurality of angle adjusting retainers to alter said angle between said back support and said seat that to a decline that is less than horizontal.

13. The adjusting bench according to claim 1, wherein said adjustable leg is positioned in one of said plurality of angle adjusting retainers to alter said angle between said back support and said seat that to an angle of up to 90 degrees.

14. The adjusting bench according to claim 1, wherein said angle of said seat support provides for said seat support to be raised or lowered relative to said back support.

15. The adjusting bench according to claim 14 wherein said seat support is raised or lowered by removing a second pin from a plate, repositioning said seat support, aligning a second plurality of holes in said plate with a plurality of holes in said seat support and inserting said second pin in said second plurality of holes.

16. The adjusting bench according to claim 1, wherein an angle between said first leg member and said second leg member is adjustable.

17. The adjusting bench according to claim 16, wherein said second leg member is adjustable by removing a pin from a plate, repositioning said second leg member, aligning a plurality of holes in said plate with a plurality of holes in said second leg member and inserting said pin.

18. The adjusting bench according to claim 1, wherein adjustment of said back support does not result in movement of said seat frame.

* * * * *